US007436298B2

(12) United States Patent
Rajapakse et al.

(10) Patent No.: US 7,436,298 B2
(45) Date of Patent: Oct. 14, 2008

(54) CONTAINER SECURITY AND MONITORING

(75) Inventors: Ravindra U. Rajapakse, San Francisco, CA (US); Steven J. Farrell, Sunnyvale, CA (US); Mark S. Weidick, San Francisco, CA (US); Nicholas D. Cova, El Cerrito, CA (US); John L. Goodell, Sunnyvale, CA (US); Edward D. Schultheis, Auburn, CA (US); William S. Dawson, Monterey, CA (US); Kent G. Merritt, Sunnyvale, CA (US)

(73) Assignee: Savi Technology, Inc., Mountain View, CA (US)

( * ) Notice: Subject to any disclaimer, the term of this patent is extended or adjusted under 35 U.S.C. 154(b) by 317 days.

(21) Appl. No.: 10/974,481

(22) Filed: Oct. 27, 2004

(65) Prior Publication Data

US 2005/0134457 A1 Jun. 23, 2005

Related U.S. Application Data

(60) Provisional application No. 60/514,968, filed on Oct. 27, 2003.

(51) Int. Cl.
*G08B 13/08* (2006.01)

(52) U.S. Cl. ..... 340/545.6; 340/545.2; 340/539.1; 340/539.13; 340/539.26; 340/539.31; 340/540; 340/572.1

(58) Field of Classification Search ... 340/545.1–545.6, 340/539.1, 539.13, 539.26, 539.31, 540, 340/541, 572.1, 572.3
See application file for complete search history.

(56) References Cited

U.S. PATENT DOCUMENTS 3,561,634 A * 2/1971 Meldrum ..... 220/1.5

(Continued)

FOREIGN PATENT DOCUMENTS

EP 0 467 036 A2 1/1992

(Continued)

OTHER PUBLICATIONS

PCT International Preliminary Report on Patentability (Forms PCT/IB/326, 373 and 237) mailed by the World Intellectual Property Organization on May 11, 2006 in PCT Application No. PCT/IB2004/003529, 10 pages.

(Continued)

*Primary Examiner*—Hung T. Nguyen
(74) *Attorney, Agent, or Firm*—Haynes and Boone, LLP

(57) ABSTRACT

A device has a support that can resiliently and removably grip an edge portion of a member with first and second portions thereof disposed on opposite sides of the member. A further portion on the first portion can operatively couple sensing structure to an electrical conductor portion on the third portion. A different embodiment has a support that can resiliently and removably grip an edge portion of a member with first and second portions thereof disposed on opposite sides of the member. A further portion on the support has circuitry coupled to a wireless communication portion on the first portion. Another embodiment has a support with structure supported thereon, the support resiliently and removably gripping the edge portion of a movable door with first and second portions of the support disposed on opposite sides of the edge portion.

51 Claims, 5 Drawing Sheets

U.S. PATENT DOCUMENTS

| | | | | | |
|---|---|---|---|---|---|
| 3,597,753 | A | | 8/1971 | Tabankin | |
| 3,665,449 | A | | 5/1972 | Elder et al. | |
| 3,848,243 | A | | 11/1974 | Schirmer | |
| 3,878,539 | A | | 4/1975 | Gooding | |
| 3,961,323 | A | | 6/1976 | Hartkorn | |
| 4,258,359 | A | | 3/1981 | McLamb | |
| 4,438,428 | A | | 3/1984 | Ober et al. | |
| 4,484,181 | A | | 11/1984 | Schwartz | |
| 4,683,461 | A | | 7/1987 | Torre | |
| 4,688,244 | A | | 8/1987 | Hannon et al. | |
| 4,808,974 | A | | 2/1989 | Cantley | |
| 5,072,212 | A | | 12/1991 | Sorenson | |
| 5,247,279 | A | | 9/1993 | Sato | |
| 5,341,123 | A | | 8/1994 | Schuman, Sr. et al. | |
| 5,410,899 | A | * | 5/1995 | McConnell | 70/370 |
| 5,422,627 | A | | 6/1995 | Tap et al. | |
| 5,448,220 | A | | 9/1995 | Levy | |
| 5,479,152 | A | * | 12/1995 | Walker et al. | 340/545.6 |
| 5,499,014 | A | | 3/1996 | Greenwaldt | |
| 5,572,191 | A | | 11/1996 | Lundberg | |
| 5,615,247 | A | | 3/1997 | Mills | |
| 5,656,996 | A | * | 8/1997 | Houser | 340/541 |
| 5,729,199 | A | | 3/1998 | Cooper et al. | |
| 5,735,495 | A | * | 4/1998 | Kubota | 248/100 |
| 5,804,810 | A | | 9/1998 | Woolley et al. | |
| 5,844,482 | A | | 12/1998 | Guthrie et al. | |
| 5,907,812 | A | | 5/1999 | Van De Berg | |
| 5,913,180 | A | * | 6/1999 | Ryan | 702/45 |
| 5,917,433 | A | | 6/1999 | Keillor et al. | |
| 5,936,523 | A | | 8/1999 | West | |
| 5,939,982 | A | | 8/1999 | Gagnon et al. | |
| 5,959,568 | A | | 9/1999 | Woolley | |
| 5,999,091 | A | | 12/1999 | Wortham | |
| 6,236,911 | B1 | | 5/2001 | Kruger | |
| 6,271,753 | B1 | | 8/2001 | Shukla | |
| 6,274,856 | B1 | | 8/2001 | Clothier et al. | |
| 6,281,793 | B1 | | 8/2001 | Haimovich et al. | |
| 6,444,961 | B2 | | 9/2002 | Clothier et al. | |
| 6,483,473 | B1 | | 11/2002 | King et al. | |
| 6,497,656 | B1 | | 12/2002 | Evans et al. | |
| 6,512,455 | B2 | | 1/2003 | Finn et al. | |
| 6,608,554 | B2 | | 8/2003 | Lesesky et al. | |
| 6,736,316 | B2 | | 5/2004 | Neumark | |
| 6,744,352 | B2 | | 6/2004 | Lesesky et al. | |
| 6,747,558 | B1 | | 6/2004 | Thorne et al. | |
| 6,748,292 | B2 | | 6/2004 | Mountz | |
| 6,753,775 | B2 | | 6/2004 | Auerbach et al. | |
| 6,796,142 | B2 | | 9/2004 | Burn | |
| 6,844,829 | B2 | | 1/2005 | Mayor | |
| 6,919,803 | B2 | | 7/2005 | Breed | |
| 6,975,224 | B2 | | 12/2005 | Galley, III et al. | |
| 7,034,683 | B2 | * | 4/2006 | Ghazarian | 340/568.1 |
| 7,098,784 | B2 | | 8/2006 | Easley et al. | |
| 7,132,926 | B2 | | 11/2006 | Vaseloff et al. | |
| 2004/0012502 | A1 | | 1/2004 | Rasmussen | |
| 2004/0069850 | A1 | | 4/2004 | De Wilde | |
| 2004/0119588 | A1 | | 6/2004 | Marks | |
| 2004/0174259 | A1 | | 9/2004 | Peel et al. | |
| 2004/0183673 | A1 | | 9/2004 | Nageli | |
| 2004/0233041 | A1 | | 11/2004 | Bohman et al. | |
| 2004/0263329 | A1 | | 12/2004 | Cargonja et al. | |
| 2006/0012481 | A1 | | 1/2006 | Rajapakse et al. | |

FOREIGN PATENT DOCUMENTS

| | | | |
|---|---|---|---|
| EP | 0 825 554 | A1 | 2/1998 |
| EP | 0 984 400 | A2 | 3/2000 |
| WO | WO 98/32092 | | 7/1998 |
| WO | WO 01/08116 | | 2/2001 |
| WO | WO 01/27891 | | 4/2001 |
| WO | WO 02/089084 | | 11/2002 |

OTHER PUBLICATIONS

Roderick E. Thorne, Philip J. Keleshian, Timothy R. Redler, Joseph S.Chan and Nikola Cargonja, U.S. Appl. No. 60/332,480, filed Nov. 9, 2001 for "Method and Apparatus for Providing Container Security with a Tag".

Steven J. Farrell, Blair B. LaCorte, and Ravindra U. Rajapakse, U.S. Appl. No. 11/158,300, filed Jun. 21, 2005 for "Method and Apparatus for Monitoring Mobile Containers".

Nikola Cargonja, Timothy R. Redler, Richard D. Lockyer and Kent G. Merritt, U.S. Appl. No. 11/266,018, filed Nov. 3, 2005 for "Method and Apparatus for Monitoring the Voltage of a Battery".

Richard D. Lockyer, U.S. Appl. No. 60/732,240, filed Nov. 1, 2005 for "Apparatus and Method for Capacitive Sensing of Door Position".

Richard D. Lockyer and David H. Beauley, U.S. Appl. No. 11/336,402, filed Jan. 20, 2006 "Method and Apparatus for Capacitive Sensing of Door Position".

PCT Search Report (Forms PCT/ISA/220 and 210) and PCT Written Opinion (Form PCT/ISA/237) mailed by the European Patent Office on Feb. 11, 2005 in PCT Application No. PCT/IB2004/003529, 17 pages.

Nikola Cargonja, Philip J. Keleshian, Roderick E. Thorne and Steven J. Farrell, U.S. Appl. No. 60/454,067, filed Apr. 18, 2003 for "Techniques for Detecting Intrusion Into a Cargo Container".

Nikola Cargonja, Philip J. Keleshian, Roderick E. Thorne and Ravindra U. Rajapakse, U.S. Appl. No. 60/496,056, filed Aug. 18, 2003 for "Techniques Using Cargo Container Motion as a Factor in Intrusion Detection".

Gustava Padilla and Roderick E. Thorne, U.S. Appl. No. 60/504,580, filed Sep. 19, 2003 for "Technique Using Cargo Container Door Sensor as a Factor In Intrusion Detection".

Nicholas D. Cova, Mark S. Weidick, and Blair B. LaCorte, U.S. Appl. No. 60/518,553, filed Nov. 7, 2003 for "Method and Apparatus for Increased Container Security".

Ravindra U. Rajapakse, Roderick E. Thorne, Robert Fraser Jennings, Steven J. Farrell and Liping Julia Zhu, U.S. Appl. No. 60/588,229, filed Jul. 15, 2004 for "Method And Apparatus for Effecting Control or Monitoring Within a Container".

Nicholas D. Cova, Mark S. Weidick and Blair B. LaCorte, U.S. Appl. No. 10/984,026, filed Nov. 8, 2004 for "Method and Apparatus for Increased Container Security".

Ravindra U. Rajapakse, Steven J. Farrell, Mark S. Weidick, Nicholas D. Cova, John L. Goodell, Edward D. Schultheis and William S. Dawson, U.S. Appl. No. 10/975,035, filed Oct. 27, 2004 for "Security and Monitoring For Containers".

Ravindra U. Rajapakse, Steven J. Farrell, Nicholas D. Cova, Mark S. Weidick, Roderick E. Thorne and Gustavo Padilla, U.S. Appl. No. 60/514,968, filed Oct. 27, 2003 for "Mechanisms for Secure RF Tags on Containers".

* cited by examiner

CONTAINER SECURITY AND MONITORING

This application claims the priority under 35 U.S.C. §119 of U.S. provisional application No. 60/514,968 filed Oct. 27, 2003, the disclosure of which is hereby incorporated herein by reference.

FIELD OF THE INVENTION

This invention relates in general to monitoring and security for containers and, more particularly, to devices that provide automated monitoring and security for shipping containers.

BACKGROUND

A variety of different products are shipped in cargo containers. Products are packed into the container by a shipper, after which the container doors are closed and then secured with some type of lock. The container is then transported to a destination, where a recipient removes the lock and unloads the container.

The shipper often finds it advantageous to have some form of monitoring while the container is being transported. For example, the cargo within the container may be relatively valuable products such as computers or other electronic devices, and thieves may attempt to break into the container and steal these products if the container is left unattended during transport. Alternatively, the cargo may be products such as fresh fruit, for which it is advantageous to continuously monitor environmental conditions such as temperature and humidity, in order to avoid or minimize spoilage.

It is not cost-feasible to have a person watch a container at all times in order to provide security and/or monitoring. Accordingly, electronic systems have previously been developed to provide a degree of automated security and/or monitoring. Although these pre-existing systems have been generally adequate for their intended purposes, they have not been satisfactory in all respects.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
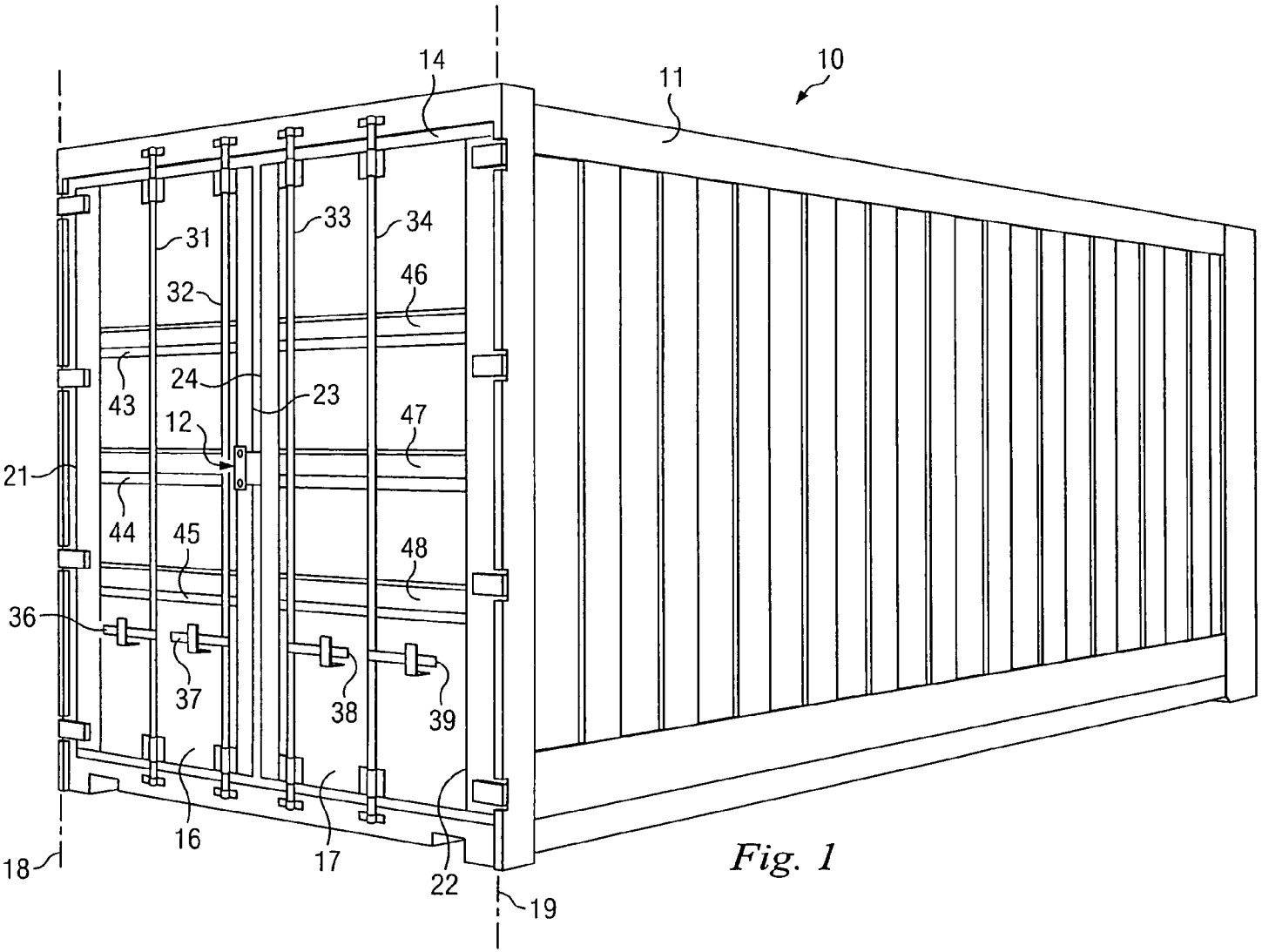
FIG. 1 is a diagrammatic perspective view of an apparatus that includes a container and a security and monitoring device, and that embodies aspects of the present invention.

FIG. 1 is a diagrammatic perspective view of an apparatus 10 that includes a container 11, and a security and monitoring device 12. The security and monitoring device 12 embodies aspects of the present invention, and is discussed in more detail later.

The container 11 is a conventional shipping container of a well-known type, and in particular complies with an industry-standard specification known as an ISO 668:1995(E) Series 1 freight container. The vast majority of containers that are currently in commercial use conform to this ISO standard. This particular type of container is shown by way of example. The present invention is not limited to this particular type of container, or to containers in general.

The container 11 is made almost entirely of steel or aluminum, except that a not-illustrated floor within the container may be made of either wood or metal. The container 11 has at one end a large opening 14 with an approximately square shape. Two rectangular doors 16 and 17 are supported by hinges for pivotal movement about respective spaced vertical axes 18 and 19. The axes 18 and 19 are located near respective side edges of the opening 14. The doors 16 and 17 are each shown in a closed position in FIG. 1, and can each pivot about 90° to 270° outwardly from this position to an open position, which is not shown in the drawings.

The doors 16 and 17 each have a respective vertical outer edge 21 or 22, which is disposed adjacent the associated pivot axis 18 or 19. In addition, each of the doors 16 and 17 has a respective inner edge portion 23 or 24. When the doors 16 and 17 are in the closed position of FIG. 1, the inner edge portions 23 and 24 are adjacent, with a small gap between them. According to the ISO standard, the inner edge portions 23 and 24 of the doors 16 and 17 are each an approximately rectangular metal part, with a cross-sectional size of about 45 mm by 95 mm. For example, the door edge portions 23 and 24 may be rectangular steel tubes of this size.

In order to secure the doors 16 and 17 in their closed positions, the door 16 has two vertical rods 31 and 32 rotatably supported thereon, and the door 17 has two vertical rods 33 and 34 rotatably supported thereon. Each of the rods 31-34 has a respective handle 36-39 thereon. The handles 36-39 can be used to manually rotate the rods 31-34 between locked and released positions. In the locked position, each handle can engage a retention bracket mounted on the associated door, and the bracket maintains the handle and rod in the locked position. As each rod is pivoted between its locked and released positions, each end thereof can move into or out of engagement with a locking bracket or locking recess provided on the container 11.

The door 16 has three corrugations or recesses 43-45 that extend horizontally and are vertically spaced. Similarly, the door 17 has three corrugations or recesses 46-48 that extend horizontally and are vertically spaced.

When the container 11 has been packed with products that are to be shipped, various considerations can come into play. First, there are situations in which it is desirable to be able to monitor environmental conditions within the container. For example, products such as fresh fruit may keep better if environmental conditions within the container 11 remain within certain acceptable limits, and so it is desirable to monitor relevant environmental conditions such as temperature or humidity. Another consideration is that, once the doors 16 and 17 have been closed and secured at the point of shipment, there are situations in which it is desirable to have some form of security and monitoring in order to verify that the doors are not opened again until the container arrives at its destination. For example, while the container is in transit, thieves may attempt to break into the container 11 in order steal valuable cargo therein, such as computers or other electronic devices. In order to handle these various different types of situations, the device 12 provides security and monitoring capability with respect to both environmental conditions and container intrusion.

Figure 2:
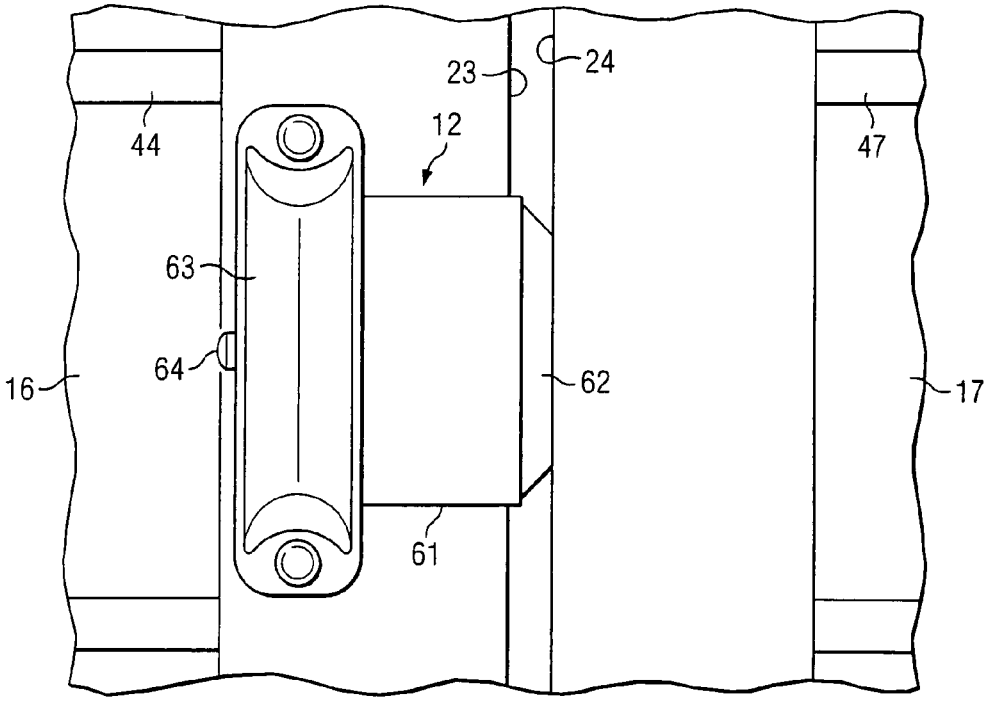
FIG. 2 is a diagrammatic fragmentary front view of a portion of the apparatus of FIG. 1, in a significantly enlarged scale.

FIG. 2 is a diagrammatic fragmentary front view of a portion of the apparatus of FIG. 1, in a significantly enlarged scale. The structure and operation of the security and monitoring device 12 are discussed in detail later, but some aspects of the device 12 can be seen in FIG. 2. The device 12 includes a resilient metal support clip 61. The support clip 61 is approximately C-shaped, and grips around the rectangular edge portion 24 of the door 16, in order to removably support the device 12 on the door 16. An anti-tamper part 62 is provided on the support clip 61, on the inner side of the doors. A wireless communication module 63 is mounted on an outer side of the support clip 61, and the support clip 61 has at one end a tab 64 that projects outwardly beyond the wireless communication module 63. The wireless communication module 63 has a relatively low profile, to reduce the likelihood that it would be struck and damaged by some other device.

Figure 3:
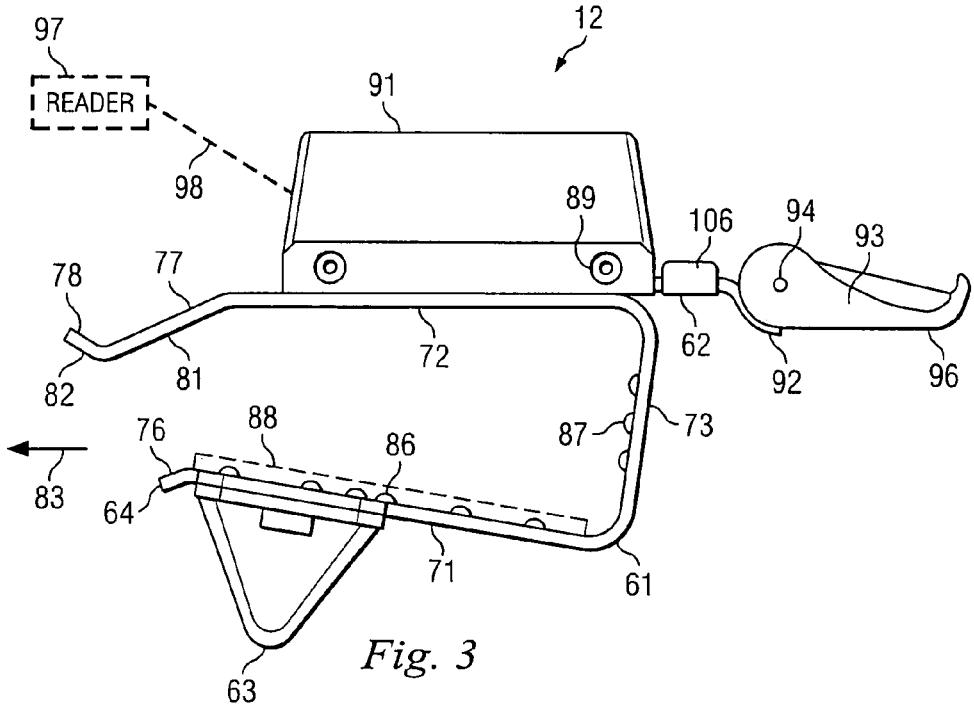
FIG. 3 is a diagrammatic top view of the security and monitoring device of FIG. 1, without the shipping container.

FIG. 3 is a diagrammatic top view of the device 12, without the shipping container. The resilient metal support clip 61 is a single integral part and, as mentioned above, is bent to have approximately a C-shape. In particular, the support clip 61 has spaced leg portions 71 and 72, and a bight portion 73 that extends between and is coupled to respective ends of the leg portions 71 and 72. The tab 64 is provided at an outer end of the leg portion 71, and is inclined at a slight angle to the remainder of the leg portion 71, so as to define an inclined surface portion 76. The outer end of the leg portion 72 is bent to define an inclined portion 77 that extends at an angle to the main part of the leg portion 72, and a further inclined portion 78 that extends at an angle to the inclined portion 77. The inclined portions 77 and 78 define respective inclined surface portions 81 and 82.

When the device 12 is being installed on the edge portion 24 of the door 16 (FIG. 2), the device 12 is manually moved toward the edge portion 24 in the direction indicated by an arrow 83. The inclined surface portions 76 and 82 engage outer corners of the edge portion 24 of the door 16, and help to spread the leg portions 71 and 72 against the inherent resilience of the support clip 61. The inclined portions 64, 78 and/or 77 can also be manually grasped in order to help manually spread the leg portions 71 and 72, to facilitate installation of the device 12 on the door edge portion 23.

After the door edge portion 23 is fully received within the support clip 61, the inclined surface portion 81 engages an inner corner of the rectangular door edge portion 23. In association with the resilience of the support clip 61, the inclined surface portion 81 continuously and yieldably urges the support clip 61 in the direction of the arrow 83 with respect to the door edge portion 23. This maintains the support clip 61 in place, and actively resists its unintended removal. In fact, as the support clip 61 is being installed on the edge portion 23, and once the inclined surface 81 has moved into engagement with an inner corner of the edge portion 23, the surface 81 and the resilience of the support clip 61 will tend to cause the support clip 61 to automatically snap to its final position.

The device 12 can be removed from the door edge portion 23 by manually pulling the device 12 in a direction opposite the arrow 83. The engagement of the inclined surface 81 with an inner corner of the edge portion 23 will help to spread the leg portions 71 and 72 against the resilience of the support clip 61. In addition, if necessary, the tab 64 and the inclined portion 78 or 77 can be grasped and manually pulled apart, in order to help spread the leg portions 71 and 72.

The inner side of the leg portion 71 has a plurality of approximately hemispherical bosses 86, which each project toward the opposite leg portion 72. The bight portion 73 has a plurality of similar bosses 87 on the inner side thereof. The bosses 86 and 87 serve as gripping structure that helps resist movement of the support clip 61 relative to the door edge portion 23. In particular, the bosses resist detachment of the support clip 61 due to movement in a horizontal direction opposite the arrow 83, and also resist vertical downward sliding movement of the support clip 61 along the door edge portion 23. In place of the bosses 86 and 87, it would alternatively be possible to provide gripping structure in the form of a non-slip sheet 88 that is securely mounted to one or more of the inner surfaces of the support clip 61. The sheet 88 could, for example, be made of rubber or some other suitable non-slip material.

A sensor module 91 is mounted on the leg portion 72 of the support clip 61. An outer housing of the sensor module 91 is visible in FIG. 3. This housing is held in place by several fasteners 89, such as rivets or screws. Within the housing, the sensor module 91 has circuitry and other structure that is discussed later. The circuitry includes sensors which can monitor conditions within the container, including environmental conditions like temperature and humidity.

A metal lever 92 is disposed behind the anti-tamper part 62. The lever 92 can move in relation to the anti-tamper part 62, in a manner described in detail later. A pivot axle 94 is fixedly supported near an outer end of the lever 92, and pivotally supports a door-engaging member 93, as described in more detail later. In the disclosed embodiment, the member 93 is made of plastic, but it could alternatively be made of any other suitable material. The member 93 has a door-engaging surface 96, which can slidably engage an inner surface of the door edge portion 24 of the door 17 (FIG. 2).

FIG. 3 shows in broken lines an optional reader 97, which is a type of device that is known in the art. The reader 97 is physically separate from the device 12, and would be physically mounted on an inner surface of the container, at a location spaced from the device 12. The reader 97 would be electrically coupled at 98 to the circuitry within the sensor module 91. This electrical coupling could, for example, be in the form of an interface conforming to an industry standard known as RS-485. Broadly speaking, the reader 97 can function as a form of sensor. For example, when the container 11 contains products or pallets that carry radio frequency identification (RFID) tags of a type known in the art, the reader 97 can collect information from the tags through radio frequency signals, and can then pass the collected information at 98 to the circuitry within the sensor module 91. Thus, the inventory within the container can be automatically and continuously monitored electronically.

Figure 4:
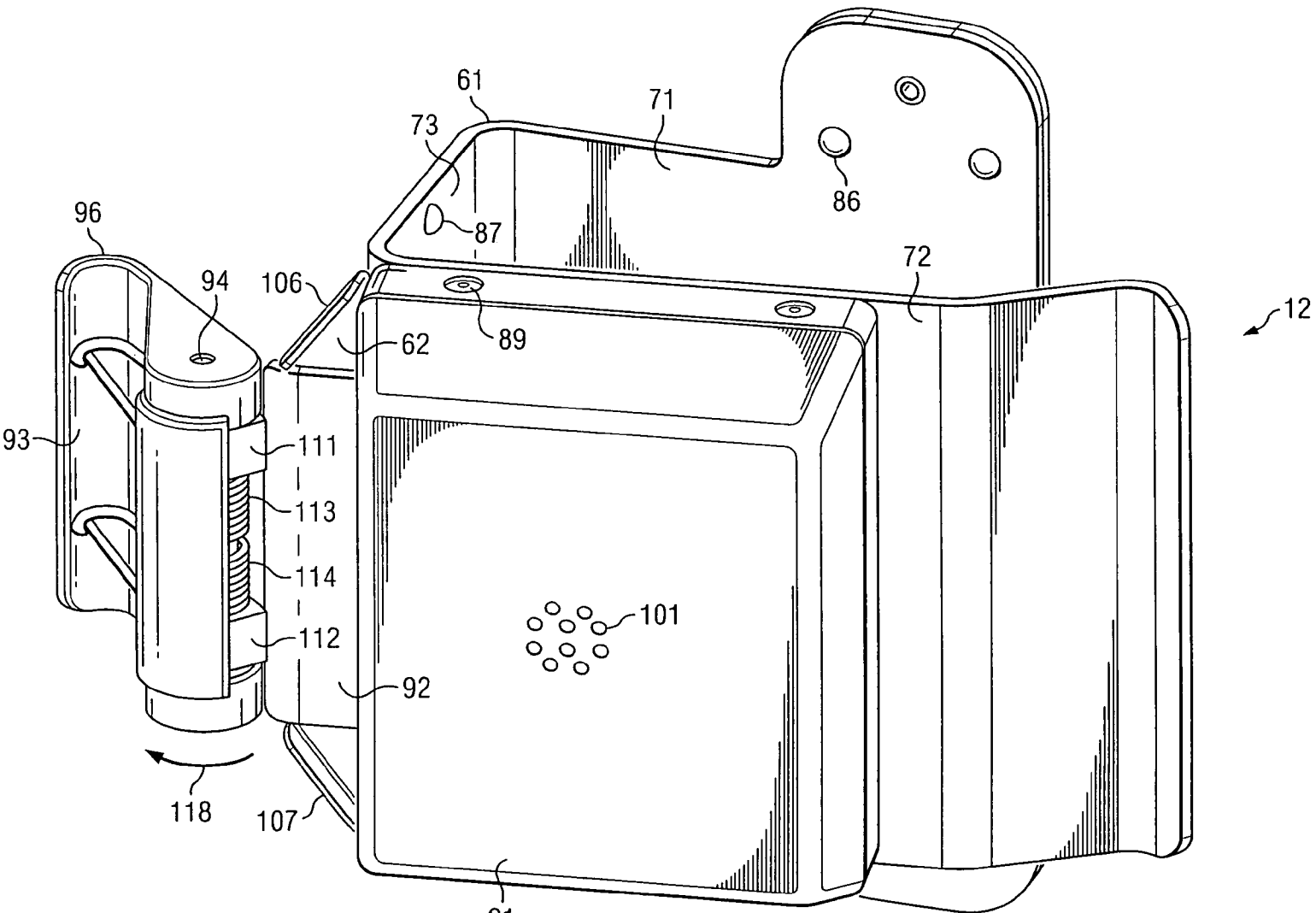
FIG. 4 is a diagrammatic perspective view of the rear side of the security and monitoring device.

FIG. 4 is a diagrammatic perspective view of the rear side of the device 12. It will be noted that the housing of the sensor module 91 has a rear wall with a cluster of holes 101 extending through it. These holes 101 provide the sensors inside the sensor module 91 with suitable access to ambient air, in order to achieve accurate sensing and monitoring of conditions such as temperature and humidity. FIG. 4 shows that the anti-tamper part 62 has a pair of spaced, rearwardly-projecting tabs 106 and 107, which are disposed on opposite sides of the lever 92. The portion of the lever 92 which is visible in FIG. 4 is capable of limited forward and rearward movement, toward and away from the anti-tamper part 62, as discussed in more detail later.

Two plastic supports 111 and 112 are fixedly mounted at spaced locations on the outer end of the lever 92, and fixedly support the pivot axle 94. The door-engaging member 93 has two spaced side portions that cooperate with the ends of the axle 94, so that the member 93 can pivot on the axle 94 with respect to the lever 92 and the supports 111 and 112. Two coil springs 113 and 114 encircle the axle 94 between the supports 111 and 112. The coil spring 113 has one end coupled to the support 111, and its other end coupled to the member 93. Similarly, the coil spring 114 has one end coupled to the support 112, and its other end coupled to the member 93. The coil springs 113 and 114 urge the member 93 to pivot relative to the lever 92, in a direction indicated by an arrow 118.

Figure 5:
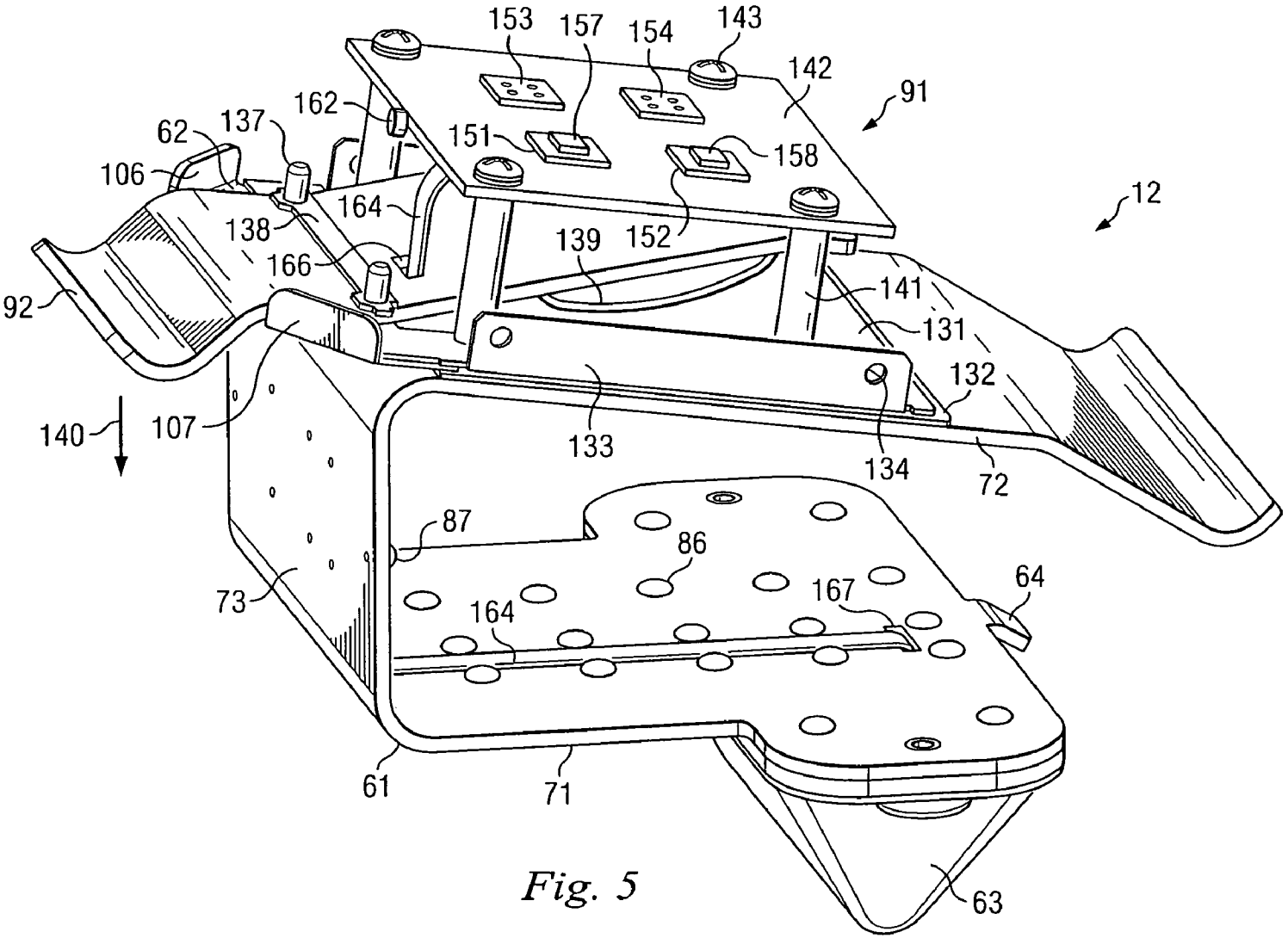
FIG. 5 is a diagrammatic perspective bottom view of the security and monitoring device, with certain structural parts omitted for clarity.

FIG. 5 is a diagrammatic perspective bottom view of the device 12, with selected parts omitted for clarity. In particular, the housing is omitted from the sensor module 91, and the supports 111-112, springs 113-114, axle 94 and member 93 are omitted from the outer end of the lever 92. A planar metal base plate 131 is fixedly secured to the leg portion 72 of the support clip 61. In the disclosed embodiment, the base plate 131 is fixedly secured to the leg portion 72 by a double-sided adhesive sheet 132. However, the base plate 131 could alternatively be mounted on the leg portion 72 in any other convenient and suitable manner.

The base plate 131 has two rearwardly-projecting flanges 133 disposed on opposite sides thereof, and two spaced holes 134 are provided through each flange 133. The fasteners 89 (FIG. 4) cooperate with the holes 134 in order to hold the housing of the sensor module 91 in place. In FIG. 5, the left end of the base plate 131 has a portion that projects outwardly beyond the bight portion 73 of the support clip 61, in order to serve as the anti-tamper part 62 with the previously-mentioned tabs 106 and 107.

Two spaced metal studs 137 are fixedly mounted on the base plate 131. The lever 92 extends between the studs 137, and has in each side edge a not-illustrated recess that receives a respective stud 137, in order to prevent any significant lengthwise movement of the lever 92. A retainer 138 extends between the studs 137, and has holes that receive the studs 137 with a friction fit. The lever 92 can rock or pivot about a pivot axis located adjacent and parallel to the retainer 138. A conical coil spring 139 is disposed between the base plate 131 and the right end of the lever 92. The spring 139 resiliently urges the right end of the lever 92 in a rearward direction away from the base plate 131, which means that the left end of the lever 92 is resiliently urged in a forward direction, as indicated by an arrow 140.

Four parallel cylindrical supports 140 are each fixed at one end to the base plate 131, and project outwardly therefrom. A circuit board 142 is secured to the outer ends of the supports 141 by a plurality of screws 143. The device 12 includes a not-illustrated battery, which provides electrical power to circuitry within the device 12, including the circuitry on the circuit board 142. Since FIG. 5 is diagrammatic, it does not show all of the circuit components that are mounted on the circuit board 142. Instead, FIG. 5 shows only selected components that are relevant to an understanding of the present invention.

In this regard, four sockets 151-154 are all mounted on the side of the circuit board 142 facing away from the lever 92, and are each coupled electrically to a bus that is part of the circuitry on the circuit board 142. The sockets 151-154 permit sensors to be easily added to and removed from the device 12 in a modular fashion. FIG. 5 shows a temperature sensor 157 removably inserted in the socket 151, and a humidity sensor 158 removably inserted in the socket 152. The sockets 153 and 154 are shown as empty, but could receive other types of sensors, including but not limited to a pressure sensor, a moisture sensor, a vibration sensor, a shock sensor, a radiation sensor (for detecting radioactive emissions), and/or a gas sensor (for detecting hazardous or poisonous gases, such as hydrogen cyanide, or phosgene).

A known type of light sensor 162, such as a photocell, is mounted on the circuit board 142 adjacent one edge thereof. The housing for the sensor module 91 has a small opening in one side thereof, which is not visible in the drawings. This opening is adjacent to the light sensor 162, and permits the light sensor 162 to monitor whether or not there is visible light within the container.

A ribbon cable 164 has one end electrically coupled to the circuit board 142. From the circuit board 142, the ribbon cable 164 extends through aligned openings in the lever 92, the base plate 131, and the leg portion 72 of the support clip 61, and then extends along inner surfaces of the bight portion 73 and the leg portion 71 of the support clip 61. The ribbon cable 164 is adhesively secured to these inner surfaces of the support clip 61, but could alternatively be held in place in any other suitable manner. The ribbon cable 164 then passes through an opening 167 provided in the leg portion 71, and into the wireless communication module 63. This end of the ribbon cable 164 is electrically coupled to not-illustrated circuitry that is provided within the wireless communication module 63.

Figure 6:
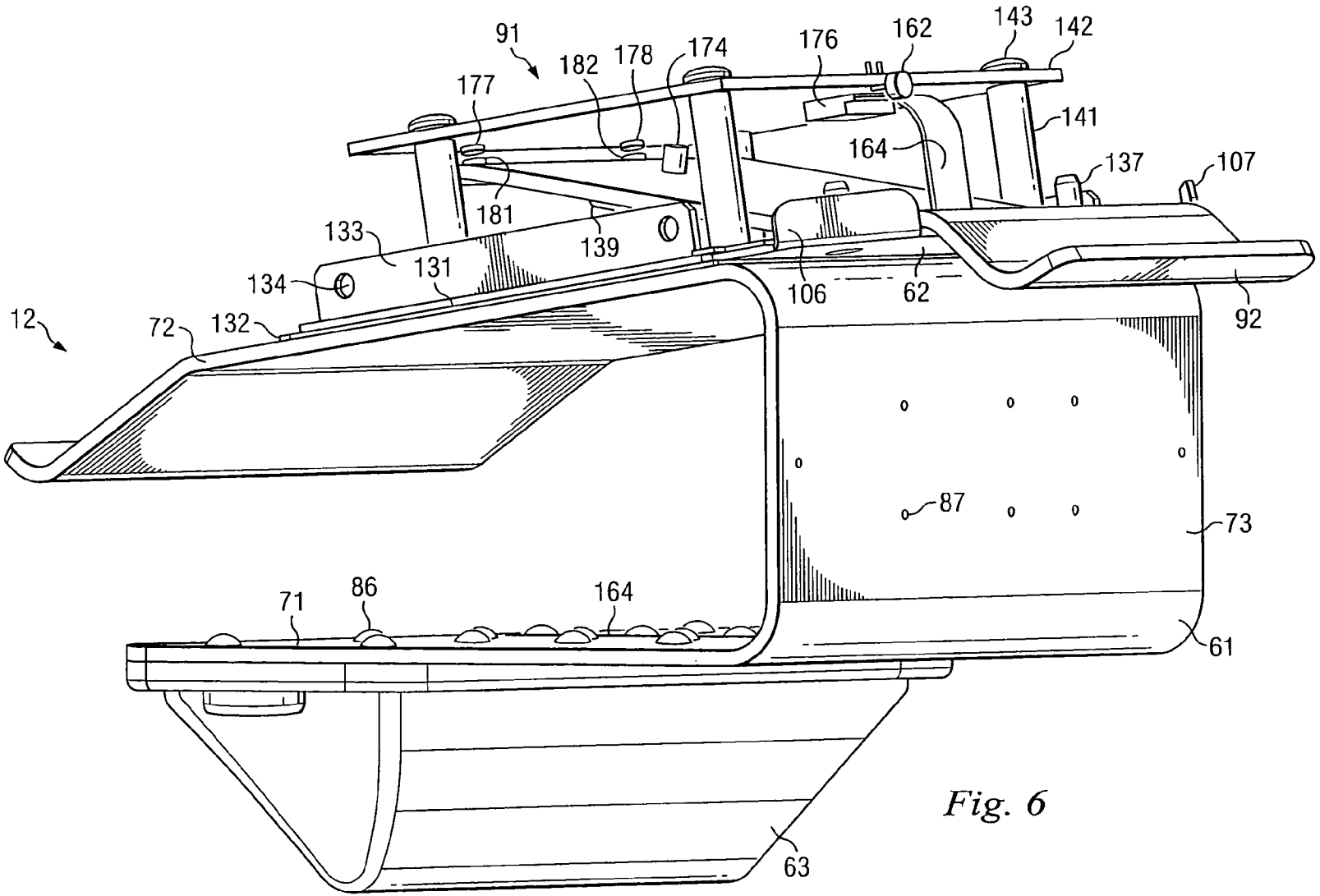
FIG. 6 is a diagrammatic perspective top view of the security and monitoring device, with certain structural parts omitted for clarity.

FIG. 6 is a diagrammatic perspective top view of the device 12, showing the same structure as FIG. 5, but from a different angle. FIG. 6 shows a stop 174 which is fixedly mounted on the lever 92, and which can engage the circuit board 142 in order to limit movement of that end of the lever 92 toward the circuit board 142 under the urging of the coil spring 139. FIG. 6 also shows a header or connector 176 which is provided at one end of the ribbon cable 164, in order to facilitate an electric coupling of the ribbon cable 164 to the circuit board 142.

Two Hall effect sensors 177 and 178 are provided on the side of the circuit board 142 facing the lever 92, and serve as proximity sensors. Two magnets 181 and 182 are fixedly mounted on the adjacent end of the lever 92, in a manner so that each magnet is aligned with a respective one of the Hall effect sensors 177 and 178. As the lever 92 undergoes reciprocal pivotal movement, the magnets 181 and 182 move toward and away from the Hall effect sensors 177 and 178, and serve as magnetic field generators that actuate and deactuate the Hall effect sensors. The stop 174 ensures that the magnets 181 and 182 can come close to the sensors 177 and 178 but do not touch the sensors, for example to avoid damage to or wear of the magnets or sensors.

The foregoing discussion includes an explanation of how the security and monitoring device 12 can be removably installed on the door 16 of the container 11, and removed from the door. Now, a brief explanation of the operation of the device 12 will be provided. For the purpose of this discussion, it is assumed that the device 12 has already been installed on the edge portion 23 of the door 16.

With reference to FIG. 5, the coil spring 139 resiliently urges pivotal movement of the lever 92 in a direction that causes the opposite end of the lever 92 to be urged in the direction of the arrow 140, or in other words in a direction away from the interior of the container. In addition, with reference to FIG. 4, the coil springs 113 and 114 urge pivotal movement of the door-engaging member 93 in the direction of the arrow 118, which means that the door-engaging surface 96 is urged in a direction away from the interior of the container. The spring 139 and the springs 113 and 114 are selected so that, with respect to the member 93, the springs 113 and 114 collectively exert an effective force that is greater than the effective force exerted by the spring 139 through the lever 92. Stated differently, when an external force is exerted on the door-engaging surface 96, the lever 92 will pivot relative to the sensor module 91 before the member 93 pivots relative to the lever 92.

As a specific example, assume that the container door 16 with the device 12 thereon is in its closed position, and that the container door 17 is being moved from its open position to its closed position. The edge portion 24 of the door 17 will engage the door-engaging surface 96 on the member 93, and press the member 93 toward the interior of the container. As the member 93 is moved inwardly, the member 93 will not initially pivot with respect to the lever 92, but instead the lever 92 will pivot against the force of the coil spring 139. The coil spring 139 will be compressed and, with reference to FIG. 6, the magnets 181 and 182 will move away from the Hall effect sensors 177 and 178.

At some point, the lever 92 will reach the end of its effective range of pivotal movement. Then, as the door 17 continues to close, the lever 92 will remain stationary, and the door-engaging member 93 will pivot about the axle 94 in relation to the lever 92, until the door 17 is in its closed position. The provision of the movable member 93, in association with the relative strengths of the various springs, ensures that the lever 92 will be moved to and maintained in its actuated position, even if the doors 16 and 17 are not entirely coplanar, or if one of the doors is bent or otherwise has some skew. That is, the movable member 93 and the relative strengths of the springs permit the movable member 93 to accommodate misalignment or play in the positions of the two container doors, while ensuring that the lever 92 is reliably moved between its actuated and deactuated positions as the door 17 is moved to and from its closed position.

Assume now that, after both of the containers doors 16 and 17 have been moved to and secured in their closed positions, the container 11 is dispatched for transport to a remote destination. In addition, assume that someone opens the door 17 without authorization while the container is en route to its destination. As the door 17 is being opened, the springs 113 and 114 will initially pivot the door-engaging member 93 back to its original position, while the lever 92 remains stationary. Then, as the door 17 continues to open, the spring 139 will pivot the lever 92 back to its original position, which is shown in FIG. 6. As this occurs, the magnets 181 and 182 will be moved back to positions adjacent the Hall effect sensors 177 and 178. The output signals from the Hall effect sensors 177 and 178 will therefore change, and the circuitry on the circuit board 142 can detect this change.

The circuitry on the circuit board 142 can then send signals through the ribbon cable 164 to the wireless communication module 63. The module 63 contains a not-illustrated radio frequency (RF) antenna of a known type, as well as not-illustrated support circuitry of a known type, including a radio transceiver and a microprocessor. The wireless communication module 63 can respond to the information received through the ribbon cable 164 by transmitting a wireless signal that indicates the container door 17 has been opened. A not-illustrated reader of a known type, which is at a remote location, can receive this wireless signal and take appropriate action. For example, security personnel can be dispatched to check on the container 11, and may arrive in time to apprehend the person who opened the container without authorization.

The member 93, springs 113-114, lever 92, spring 139, magnets 181-182 and Hall-effect sensors 177-178 can be collectively viewed as a sensing portion that monitors the closed status of the container doors. Within this sensing portion, the springs 113-114, the lever 92, the spring 139, the magnets 181-182 and the sensors 177-178 collectively serve as a detection arrangement for detecting movement of the member 93, and the magnets 181-182 and sensors 177-178 effectively serve as a sensing arrangement within the detection arrangement.

With reference to FIG. 5, and as discussed above, the light sensor 162 monitors the amount of visible light that is present within the container. If the container doors are both closed, then the interior of the container will typically be dark. On the other hand, if either of the doors is open, or if there is a hole or some other breach in a container wall, ambient light can enter the container. Also, even if the container is closed, visible light can be produced within the container by a device such as a flashlight. To the extent visible light is present within the container, the light sensor 162 can detect this, and will change the output signal that it is sending to the circuitry on the circuit board 142. This circuitry can then send a signal through the ribbon cable 164 to the wireless communication module 63, which in turn can transmit a radio signal indicating that a door was apparently opened. Security personnel can then be dispatched to the container.

Still referring to FIG. 5, the sensors 157 and 158 each monitor a condition within the container, such as an environmental condition. The output signals from the sensors 157 and 158 are each monitored by the circuitry on the circuit board 142. In the disclosed embodiment, and as mentioned above, the sensor 157 is a temperature sensor. Assume that the container is being used to transport fresh fruit, and that the container is unexpectedly delayed for some reason during unusually hot summer weather. If the circuitry on the circuit board 142 finds that the temperature within the container has increased to a point where rapid spoilage of the fresh fruit becomes likely, the circuitry can transmit a signal through the ribbon cable 164 to the wireless communication module 63, which in turn can transmit a radio signal containing an appropriate warning, so that a human may be able to take appropriate action to remedy the situation before the fruit actually spoils.

With reference to FIG. 3, if the reader 97 is present, and if there are products or pallets within the container that carry RFID tags, the reader 97 can collect information from the tags, for example to establish and monitor an inventory of what is present within the container. If anything within the container is removed (along with its RFID tag) the reader 97 can detect this. The reader 97 communicates through the interface 98 with the circuitry on the circuit board 142. If either the reader 97 or the circuitry decides there is a problem, a signal can be sent through the ribbon cable 164 to the wireless communication module 63, which can then transmit a radio signal that provides notification of the problem.

A person who is familiar with the device 12 might try to defeat its operation by inserting a thin object through the gap between the edge portions 23 and 24 of the closed container doors. In order to make this difficult or impossible, the device 12 includes the anti-tamper part 62. On a more specific level, if the anti-tamper part 62 were omitted, a thin object could be inserted between the doors, and could be used to hold the lever 92 in its actuated position while opening the door 17. Consequently, the device 12 might not detect a problem and generate an alarm. However, the anti-tamper part 62 serves as an obstruction that prevents such an inserted object from easily contacting the lever 92. Further, the tabs 106 and 107 are provided at the top and bottom edges of the anti-tamper part 62, in order to make it difficult for a thin object to be inserted around either the top or the bottom of the anti-tamper part 62.

As discussed above, the resilient support clip 61 securely and removably holds the device 12 in place on a container.

This is in contrast to a variety of existing devices, which are attached to containers in a permanent or semi-permanent manner, for example using adhesives, bolts, rivets, or the like. The resilient support clip 61 thus permits the device 12 to be quickly and easily installed, and to be quickly and easily removed. This allows the owner of the device 12 to easily move the device 12 from container to container, as needed. In this regard, shippers often lease containers, and it is the shipper rather than the container owner who has the most concern about security and monitoring of the cargo. The device 12 can be owned by a shipper, can be easily installed by the shipper on a leased container, and can later be easily removed by the shipper when the container is to be returned to its owner. As discussed above, the device 12 is specifically designed to be compatible with a particular ISO standard, and the vast majority of containers that are currently in commercial use conform to this particular ISO standard. A shipper will thus find that the device 12 can be readily interchanged among the vast majority of containers that are in commercial use. Of course, while the device 12 is advantageous in association with this particular type of shipping container, it is not limited to use with such a container.

With respect to a given container, the device 12 can be easily and quickly repositioned on the container, for example to avoid interference between the device and a particular cargo packed inside the container, or to position the device 12 for optimum monitoring of a specific environmental condition in the container during a particular shipment. In this regard, it may be desirable in some circumstances to monitor temperature near the top of the container interior, or to check for heavier-than-air gases near the bottom of the container interior.

Although the device 12 can be positioned at a variety of locations along the edges of a container door, an advantage of the device 12 is that it can be mounted on one door so that it is adjacent to and monitors an edge of another door, where the monitored edge is opposite from the hinges of the other door. This permits the device 12 to be more sensitive to a door-opening condition than units that are installed on or near a door hinge. This is because, during a given amount of pivotal movement of a door, the leading edge of the door moves significantly farther than a portion of the door near the hinge.

In the disclosed embodiment, and with reference to FIG. 5, the circuit board 142 has several of the sockets 151-154 that can removably receive sensors such as those shown at 157-158. Thus, in the disclosed embodiment, the sensors are disposed within the sensor module 91, and are effectively part of the device 12. However, it would alternatively be possible for some or all of the sensors to be physically separate from the device 12. For example, an industry-standard electrical connector could be electrically coupled to the circuitry on the circuit board 142, and could be physically mounted on the exterior of the housing of the sensor module 91. One or more sensors could be mounted in the interior of the container at locations spaced from the device 12, and could be electrically coupled to the device 12 through cables that attach to the electrical connector on the sensor module housing. The electrical interface between the device 12 and each such sensor could conform to an industry standard such as that known as an RS-485 serial bus, which would permit a plurality of different sensors to all be coupled in a modular manner to a single serial bus.

Although a selected embodiment has been illustrated and described in detail, a variety of substitutions and alterations are possible without departing from the spirit and scope of the present invention, as defined by the following claims.

What is claimed is:

1. An apparatus comprising a device that includes:

a support having spaced first and second portions, and adapted to resiliently and removably grip an edge portion of a member with said first and second portions disposed on opposite sides of the edge portion;

a wireless communication portion supported on said first portion of said support; and a further portion supported on said support and having circuitry that is electrically coupled to said wireless communication portion.

2. An apparatus according to claim 1, wherein said further portion is supported on said second portion of said support.

3. An apparatus according to claim 1, wherein said support includes a resilient clip, said first and second portions being respective spaced portions of said clip.

4. An apparatus according to claim 3, wherein said clip is approximately C-shaped and has a bight extending between said first and second portions thereof.

5. An apparatus according to claim 3, wherein said clip is a single integral part.

6. An apparatus according to claim 1, wherein said support has, on a side of one of said first and second portions facing the other thereof, gripping structure that resists removal of said support from the edge portion of a member.

7. An apparatus according to claim 6, wherein said gripping structure includes a plurality of bosses that project from said one of said first and second portions toward the other thereof.

8. An apparatus according to claim 6, wherein said gripping structure includes a sheet of non-slip material fixedly supported on said one of said first and second portions.

9. An apparatus according to claim 6, wherein said support includes a resilient clip, said first and second portions being respective spaced portions of said clip.

10. An apparatus according to claim 1, wherein said support includes a third portion and said first and second portions each have an end coupled to said third portion; and wherein one of said first and second portions has, near an end thereof remote from said third portion, a surface oriented for engagement with part of the edge portion of a member so as to cause said first and second portions to be moved apart in response to movement of said support relative to the edge portion of a member as the support is being installed on the edge portion.

11. An apparatus according to claim 10, wherein said support includes a resilient clip, said first and second portions being respective spaced portions of said clip, and said third portion including a bight that extends between said first and second portions.

12. An apparatus according to claim 1, wherein said support includes a third portion and said first and second portions each have an end coupled to said third portion; and wherein one of said first and second portions has, near an end thereof remote from said third portion, a surface oriented for engagement with part of the edge portion of a member in a manner resisting removal of said support from the edge portion.

13. An apparatus according to claim 12, wherein said support includes a resilient clip, said first and second portions being respective spaced portions of said clip, and said third portion including a bight that extends between said first and second portions.

14. An apparatus according to claim 1, wherein said support includes a third portion and said first and second portions each have an end coupled to said third portion, said first and second portions each projecting outwardly from said third portion in approximately a first direction; and including an anti-tamper part projecting outwardly from said third portion in a second direction approximately opposite to said first direction.

15. An apparatus according to claim 1, including a container having a door movable between open and closed positions, said door having an edge portion;

wherein said further portion is supported on said second portion of said support; and wherein said support is removably supported on said edge portion of said door, with said wireless communication portion on an outer side of said door and said further portion on an inner side of said door.

16. An apparatus according to claim 15, wherein movement of said door between said open and closed positions is pivotal movement about a pivot axis, said pivot axis being located adjacent an edge of said door that is opposite from the edge portion on which said support is disposed.

17. An apparatus according to claim 16, wherein said container includes a further door having an edge portion and movable between open and closed positions about a further pivot axis, said edge portions of said doors being adjacent when said doors are each in said closed position thereof; and wherein said device includes a sensing arrangement which sensor which, when said doors are each in said closed position thereof, can detect movement of said further door away from its closed position.

18. An apparatus according to claim 15, including a sensor disposed within said container and operatively coupled to said circuitry.

19. An apparatus according to claim 15, wherein said container is an ISO 668:1995(E) Series 1 freight container.

20. An apparatus comprising a device that includes:

a support having spaced first and second portions and a third portion extending between said first and second portions, said support being adapted to resiliently and removably grip an edge portion of a member with said first and second portions disposed on opposite sides of the edge portion;

an electrical conductor portion which extends along said third portion and which can conduct at least one electrical signal therethrough; and a further portion supported on said first portion of said support for operatively coupling said electrical conductor portion to sensing structure.

21. An apparatus according to claim 20, including a reader that is capable of wireless communication with tags, that is operatively coupled to said electrical conductor portion through said further portion, and that represents the sensing structure.

22. An apparatus according to claim 20, including a plurality of sensors that are operatively coupled to said electrical conductor portion through said further portion, and that collectively represent the sensing structure.

23. An apparatus according to claim 22, wherein said further portion is configured to provide modular coupling to each of said sensors.

24. An apparatus according to claim 20, including a wireless communication portion disposed on said second portion of said support and operatively coupled to said electrical conductor portion.

25. An apparatus according to claim 20, wherein said support includes a resilient clip, said first and second portions being respective spaced portions of said clip.

26. An apparatus according to claim 25, wherein said clip is approximately C-shaped and has a bight extending between said first and second portions thereof.

27. An apparatus according to claim 25, wherein said clip is a single integral part.

28. An apparatus according to claim 20, wherein said support has, on a side of one of said first and second portions facing the other thereof, gripping structure that resists removal of said support from the edge portion of a member.

29. An apparatus according to claim 28, wherein said gripping structure includes a plurality of bosses that project from said one of said first and second portions toward the other thereof.

30. An apparatus according to claim 28, wherein said gripping structure includes a sheet of non-slip material fixedly supported on said one of said first and second portions.

31. An apparatus according to claim 28, wherein said support includes a resilient clip, said first and second portions being respective spaced portions of said clip.

32. An apparatus according to claim 20, wherein said first and second portions each have an end coupled to said third portion; and wherein one of said first and second portions has, near an end thereof remote from said third portion, a surface oriented for engagement with part of the edge portion of a member so as to cause said first and second portions to be moved apart in response to movement of said support relative to the edge portion as the support is being installed on the edge portion.

33. An apparatus according to claim 32, wherein said support includes a resilient clip, said first, second and third portions being respective portions of said clip.

34. An apparatus according to claim 20, wherein said first and second portions each have an end coupled to said third portion; and wherein one of said first and second portions has, near an end thereof remote from said third portion, a surface oriented for engagement with part of the edge portion of a member in a manner resisting removal of said support from the edge portion.

35. An apparatus according to claim 34, wherein said support includes a resilient clip, said first, second and third being respective portions of said clip.

36. An apparatus according to claim 20, including a container having a door which is movable between open and closed positions, and which has an edge portion; and wherein said support is removably supported on said edge portion of said door, with said further portion disposed on an inner side of said door.

37. An apparatus comprising a device that includes:

a container having a door which is movable between open and closed positions, and which has an edge portion; and a device which includes a support and structure supported on said support, said support having spaced first and second portions disposed on opposite sides of said edge portion of said door, and said support resiliently and removably gripping said edge portion of said door.

38. An apparatus according to claim 37, wherein said container is an ISO 668:1995(E) Series 1 freight container.

39. An apparatus according to claim 37, wherein said container has a further door which is movable between open and closed positions and which has an edge portion, said doors each moving about a respective pivot axis disposed adjacent an edge thereof opposite from said edge portion thereof, and said edge portions of said doors being adjacent when said doors are each in said closed position thereof; and wherein said structure includes a sensing arrangement which, when said doors are each in said closed position thereof, can detect movement of said further door away from said closed position thereof.

40. An apparatus according to claim 37, wherein said structure includes:

a wireless communication portion supported on said first portion of said support; and a further portion which is supported on said second portion of said support and which includes circuitry that is electrically coupled to said wireless communication portion, said wireless communication portion being disposed on an outer side of said door and said further portion being disposed on an inner side of said door.

41. An apparatus according to claim 37, wherein said support includes a resilient clip, said first and second portions being respective spaced portions of said clip.

42. An apparatus according to claim 41, wherein said clip is approximately C-shaped and has a bight extending between said first and second portions thereof.

43. An apparatus according to claim 41, wherein said clip is a single integral part.

44. An apparatus according to claim 37, wherein said support has, on a side of one of said first and second portions facing the other thereof, gripping structure that resists removal of said support from said edge portion of said door.

45. An apparatus according to claim 44, wherein said gripping structure includes a plurality of bosses that project from said one of said first and second portions toward the other thereof.

46. An apparatus according to claim 44, wherein said gripping structure includes a sheet of non-slip material fixedly supported on said side of said one of said first and second portions.

47. An apparatus according to claim 44, wherein said support includes a resilient clip, said first and second portions being respective spaced portions of said clip.

48. An apparatus according to claim 37, wherein said support includes a third portion and said first and second portions each have an end coupled to said third portion; and wherein one of said first and second portions has, near an end thereof remote from said third portion, a surface oriented for engagement with part of said edge portion of said door so as to cause said first and second portions to be moved apart in response to movement of said support relative to said edge portion of said door as the support is being installed on said edge portion.

49. An apparatus according to claim 48, wherein said support includes a resilient clip, said first and second portions being respective spaced portions of said clip, and said third portion including a bight that extends between said first and second portions.

50. An apparatus according to claim 37, wherein said support includes a third portion and said first and second portions each have an end coupled to said third portion; and wherein one of said first and second portions has, near an end thereof remote from said third portion, a surface oriented for engagement with part of said edge portion of said door in a manner resisting removal of said support from said edge portion.

51. An apparatus according to claim 50, wherein said support includes a resilient clip, said first and second portions being respective spaced portions of said clip, and said third portion including a bight that extends between said first and second portions.

* * * * *